US008602797B2

(12) United States Patent
Omae

(10) Patent No.: US 8,602,797 B2
(45) Date of Patent: Dec. 10, 2013

(54) SHIELDED CONNECTOR

(75) Inventor: Takashi Omae, Makinohara (JP)

(73) Assignee: Yazaki Corporation, Tokyo (JP)

( * ) Notice: Subject to any disclaimer, the term of this patent is extended or adjusted under 35 U.S.C. 154(b) by 39 days.

(21) Appl. No.: 13/499,023

(22) PCT Filed: Jul. 5, 2011

(86) PCT No.: PCT/JP2011/065402

§ 371 (c)(1),
(2), (4) Date: Mar. 29, 2012

(87) PCT Pub. No.: WO2012/005268

PCT Pub. Date: Jan. 12, 2012

(65) Prior Publication Data

US 2012/0190238 A1 Jul. 26, 2012

(30) Foreign Application Priority Data

Jul. 5, 2010 (JP) ..... 2010-153086

(51) Int. Cl.
*H01R 13/648* (2006.01)

(52) U.S. Cl.
USPC ..... 439/99

(58) Field of Classification Search
USPC ..... 439/98, 99, 607.41, 607.44, 607.52
See application file for complete search history.

(56) References Cited

U.S. PATENT DOCUMENTS 3,142,721 A * 7/1964 Long ..... 174/652
3,603,912 A * 9/1971 Kelly ..... 439/273
4,307,926 A * 12/1981 Smith ..... 439/607.52
4,799,902 A * 1/1989 Laudig et al. ..... 439/585
4,902,249 A * 2/1990 Morishita et al. ..... 439/607.41
5,186,655 A * 2/1993 Glenday et al. ..... 439/583
5,468,911 A * 11/1995 Leve et al. ..... 174/74 R
5,691,506 A * 11/1997 Miyazaki et al. ..... 174/652
5,707,253 A * 1/1998 Matsumoto et al. ..... 439/607.5
5,929,383 A * 7/1999 Marik et al. ..... 174/78
5,962,812 A * 10/1999 Miyazaki ..... 174/78
6,042,396 A * 3/2000 Endo et al. ..... 439/98

(Continued)

FOREIGN PATENT DOCUMENTS

EP 0986135 A1 3/2000
JP 658560 U 8/1994

(Continued)

OTHER PUBLICATIONS

International Search Report dated Sep. 6, 2011 issued in International Application No. PCT/JP2011/065402 (PCT/ISA/210).

(Continued)

*Primary Examiner* — Ross Gushi

(74) *Attorney, Agent, or Firm* — Sughrue Mion, PLLC

(57) ABSTRACT

Either displacement of a shielding sleeve itself on an outer cover is restricted or interference of a shielding member on the shielding sleeve with the outer cover as an insulating cover is prevented, so that the damage of the outer cover can be avoided. A shielded connector of the present invention includes a shielding sleeve 3, a hollow cylindrical housing 1, and a shielding terminal 2. The shielding sleeve 3 has an upstanding piece 3*c* that stands up in an outer diameter direction to prevent such an event that an end portion of a shielding member 25 or an end portion of the shielding terminal 2 comes into contact with the outer cover 22.

1 Claim, 5 Drawing Sheets

(56) References Cited

U.S. PATENT DOCUMENTS

| | | | | |
|---|---|---|---|---|
| 6,053,749 | A * | 4/2000 | Masuda et al. | 439/98 |
| 6,107,572 | A * | 8/2000 | Miyazaki | 174/75 C |
| 6,137,056 | A * | 10/2000 | Miyazaki | 174/78 |
| 6,152,745 | A * | 11/2000 | Matsumoto et al. | 439/98 |
| 6,152,746 | A * | 11/2000 | Brown | 439/99 |
| 6,261,108 | B1 * | 7/2001 | Kanagawa et al. | 439/98 |
| 6,262,374 | B1 * | 7/2001 | Matsumoto et al. | 174/74 R |
| 6,280,208 | B1 * | 8/2001 | Masuda et al. | 439/98 |
| 6,358,069 | B2 * | 3/2002 | Yoshioka et al. | 439/108 |
| 6,372,991 | B1 * | 4/2002 | Myers | 174/75 C |
| 6,398,563 | B1 * | 6/2002 | Kanagawa et al. | 439/98 |
| 6,419,521 | B2 * | 7/2002 | Kanagawa et al. | 439/582 |
| 6,452,102 | B1 * | 9/2002 | DeForest et al. | 174/75 C |
| 6,485,335 | B1 * | 11/2002 | Dewdney | 439/607.5 |
| 6,524,121 | B2 * | 2/2003 | Kanagawa | 439/98 |
| 6,530,789 | B2 * | 3/2003 | Konda | 439/98 |
| 6,558,172 | B2 * | 5/2003 | Kanagawa | 439/98 |
| 6,669,511 | B1 * | 12/2003 | Yagi et al. | 439/607.44 |
| 6,688,896 | B2 * | 2/2004 | Matsumoto | 439/98 |
| 6,695,632 | B2 * | 2/2004 | Matsumoto et al. | 439/246 |
| 6,777,616 | B2 * | 8/2004 | Beele | 174/650 |
| 6,784,368 | B2 * | 8/2004 | Imai et al. | 174/74 R |
| 6,793,532 | B2 * | 9/2004 | Saito et al. | 439/607.41 |
| 6,893,273 | B2 * | 5/2005 | Sato et al. | 439/98 |
| 6,916,205 | B1 | 7/2005 | Kaneko | |
| 7,044,756 | B1 * | 5/2006 | Asakura et al. | 439/98 |
| 7,119,281 | B2 * | 10/2006 | Sato et al. | 174/75 C |
| 7,153,146 | B2 * | 12/2006 | Shimizu et al. | 439/98 |
| 7,268,298 | B2 * | 9/2007 | Asakura et al. | 174/78 |
| 7,368,664 | B2 * | 5/2008 | Asakura et al. | 174/78 |
| 7,491,071 | B2 * | 2/2009 | Hamai et al. | 439/98 |
| 7,598,455 | B2 * | 10/2009 | Gump et al. | 174/75 C |
| 7,726,985 | B2 * | 6/2010 | Gladd et al. | 439/98 |
| 7,893,354 | B2 * | 2/2011 | Albert et al. | 174/72 A |
| 8,425,240 | B2 * | 4/2013 | Lee et al. | 439/99 |
| 8,460,015 | B2 * | 6/2013 | Deno et al. | 439/98 |
| 2001/0027040 | A1 * | 10/2001 | Yoshioka et al. | 439/98 |
| 2001/0055895 | A1 * | 12/2001 | Kanagawa | 439/98 |
| 2002/0006743 | A1 * | 1/2002 | Kanagawa et al. | 439/98 |
| 2002/0094724 | A1 * | 7/2002 | Saito et al. | 439/610 |
| 2002/0102872 | A1 * | 8/2002 | Kanagawa | 439/98 |
| 2002/0106918 | A1 * | 8/2002 | Saito et al. | 439/98 |
| 2002/0173181 | A1 * | 11/2002 | Matsumoto | 439/98 |
| 2004/0011550 | A1 | 1/2004 | Imai et al. | |
| 2006/0121758 | A1 * | 6/2006 | Asakura et al. | 439/98 |
| 2007/0173122 | A1 * | 7/2007 | Matsuoka | 439/610 |
| 2008/0113559 | A1 * | 5/2008 | Hamai et al. | 439/610 |
| 2008/0318476 | A1 * | 12/2008 | Weber et al. | 439/610 |
| 2012/0190238 | A1 * | 7/2012 | Omae | 439/620.01 |
| 2013/0084728 | A1 * | 4/2013 | Omae et al. | 439/271 |

FOREIGN PATENT DOCUMENTS

| | | | |
|---|---|---|---|
| JP | 2000294344 | A | 10/2000 |
| JP | 2002218640 | A | 8/2002 |
| JP | 2003282189 | A | 10/2003 |
| JP | 2005285748 | A | 10/2005 |
| JP | 3977094 | B2 | 6/2007 |

OTHER PUBLICATIONS

Written Opinion dated Sep. 6, 2011 issued in International Application No. PCT/JP2011/065402(PCT/ISA/237).

European Search report issued Oct. 10, 2013 in corresponding European Patent application No. 11803602.9-1801/2592701.

* cited by examiner

SHIELDED CONNECTOR

TECHNICAL FIELD

The present invention relates to a shielded connector for connecting a shielded electric wire to a mounted body.

BACKGROUND ART

For example, as the electric wire used for a wire harness that is mounted to a vehicle, the shielded electric wire that prevents influences of external noises such as an electromagnetic wave, etc. and prevents such an event that radiant noises such as an electromagnetic wave, etc. leak out to an outside from the electric wire is employed. According to this shielded electric wire, a core wire is shielded with a shielding member such as a braided shield, or the like, and then this shielding member is ground-connected to either a member that is electrically connected to a common ground portion in the vehicle or a mounted body as the common ground portion itself.

Also, as an example of the ground connecting methods applied to this shielded electric wire, the following method is commonly known. That is, the ground connecting method is applied such that an outer cover of the shielded electric wire is peeled off to expose the braided shields as a shielding member, then the braided shields are twisted into one member, then a ground connecting terminal is fixed to one end of this member by the clamping process, then the exposed portion of the braided shields is sheathed with a heat shrinkable tube, an insulating tape, or the like and is subjected to an insulating process, as occasion demands, and then a ground connecting terminal is fixed to be connected electrically to the mounted body. However, according to such ground connecting method, a large number of complicated man-hours are required of the ground connection, and therefore workability becomes worse.

Meanwhile, the shielded electric wire connector used to connect the shielded electric wire is set forth in Patent Literature 1, for example. As shown in FIG. 5, this shielded electric wire connector 30 has a shielding pipe 32 fitted in a housing 34 to shield a connection portion of a shielded electric wire 31, and a shielding connection component 35 for connecting electrically a shielding layer 33 of the shielded electric wire 31 and the shielding pipe 32. In this shielded electric wire connector 30, the shielding connection component 35 consists of two half components 37. The half components 37 are formed such that these components, when coupled together, clamp the shielding layer 33 exposed on an insulating layer 36 of the shielded electric wire. Also, each of two half components 37 consists of a metal parts 38 and a resin parts 39, both of which are integrated into one piece.

The metal parts 38 has an inner peripheral side contact piece 41 on an inner peripheral portion of a semi-annular wall portion 37*a*. This inner peripheral side contact piece 41 is pressed against the shielding layer 33 or a metal tape 40 being wound on an outer periphery of this shielding layer 33. This semi-annular wall portion 37*a* blocks an annular clearance between the shielding layer 33 of the shielded electric wire 31 and the shielding pipe 32 over its about semicircle. Also, the metal parts 38 has integrally an outer peripheral side contact piece 42 on an outer peripheral portion of the semi-annular wall portion 37*a*. This outer peripheral side contact piece 42 contacts an inner peripheral surface of the shielding pipe 32. Each of the resin parts 39 has a coupling portion that is used to couple two half components 37 together. Also, the resin parts 39 are constructed to have a part P and a part Q respectively. These parts P clamp the shielding layer 33 of the shielded electric wire 31 via the inner peripheral side contact piece 41 of the metal parts 38. Also, these parts Q clamp directly a sheath 43 by causing their protruded brims 44 to cut into an outer peripheral surface of the sheath 43 of the shielded electric wire 31.

The shielding layer 33 is exposed at the top end portion of the sheath 43 of the shielded electric wire 31. The shielding layer 33 that contains a center conductor 45 at its center portion is exposed at the top end portion of this shielding layer 33. A female terminal 47 is connected to one end portion of the center conductor 45. In this shielded electric wire connector 30, when two half components 37 are coupled together so as to put the shielding layer 33 and the sheath 43 therebetween, the inner peripheral side contact pieces 41 of the metal parts 38 are pressed strongly against the metal tape 40 on the shielding layer 33.

Also, the protruded brims 44 formed at the rear end of the resin parts 39 are cut into the inner side from the surface of the sheath 43, so that integration of the shielding connection component 35 and the shielded electric wire 31 can be ensured. Also, the outer peripheral side contact piece 42 of the metal parts 38 is elastically deformed in the direction to reduce its diameter, and then the metal parts 38 comes into contact the inner peripheral surface of the shielding pipe 32 by an elastic repulsive force of the outer peripheral side contact piece 42. Accordingly, the shielding layer 33 and the shielding pipe 32 are brought into their electrically connected state. In other words, the shielding layer 33 is electrically connected to the shielded terminal of the opposing connector (not shown) and the mounted body such as the body of the car, the common ground portion, or the like via the shielding pipe 32.

However, in such shielded electric wire connector, the metal parts 38 and the resin parts 39 are interposed between the shielding layer 33 of the shielded electric wire 31 and the shielding pipe 32 to connect electrically them. Therefore, in order to make sure of this interposition, the shielding layer 33 and the sheath 43 must be press-fitted strongly by the inner peripheral side contact pieces 41 of the metal parts 38, which are formed as the press-fitted parts, and the protruded brims 44 of the resin parts 39 respectively. In this case, when a press-fitting force applied by the inner peripheral side contact pieces 41 and the protruded brims 44 is too strong, corner portions (edge portions) at which the inner peripheral side contact piece 41 and the semi-annular wall portion 37*a* are connected respectively are engaged in the insulating layer 36 serving as the inner cover via the shielding layer 33. As a result, it may be considered that a part (sharp edge portion) of the shielding layer 33 sticks into the insulating layer 36 to damage this insulating layer, or the like and thus a fault such as a short-circuit accident between the core wire and the shielding layer 33, or the like is caused. Also, such a fault is caused such that this sheath 43 is damaged due to the engagement of the protruded brims 44 into the sheath 43.

In the meantime, in order to avoid such damage of the insulating layer 36 or the sheath 43 caused by the press-fitting force, such a ground connecting structure has been proposed that the shielding sleeve should be interposed between the outer cover (sheath) of the shielded electric wire and the braided shield that is folded back on the outer peripheral surface of the cut end portion of this outer cover (see Patent Literature 2, for example). FIG. 6 is a longitudinal sectional view showing a ground connector having such ground connecting structure.

A ground connector 61 is used to electrically connect (i.e., ground-connect) a braided shield (shielding member) 63 of a shielded electric wire 64 to the mounted body. This shielded electric wire 64 contains a core wire 62 and the braided shield 63 that is extended along the longitudinal direction of the core wire 62 to sheathe the core wire 62. Concretely, the ground connector 61 contains a conductive shielding terminal 65 being fitted to the shielded electric wire 64 such that this terminal 65 is connected electrically to the braided shield 63, and a conductive ground member 66 being fixed such that this member 66 is connected electrically to the mounted body which the shielding terminal 65 contacts and to which the shielding terminal 65 is electrically connected.

The ground member 66 is formed by bending a plate-like conductive member whose thickness is 2 mm, for example, like an almost L shape. Also, a through hole 66*d* (e.g., diameter of 14 mm) that is connected electrically to the shielding terminal 65 is formed in the ground member 66. The through hole 66*d* may be formed as a simple circular hole that has the identical diameter (e.g., diameter of 14 mm) to an outer diameter of a small diameter part 66*b* of a shielding contact 67 that constitutes a part of the shielding terminal 65. Alternately, the through hole 66*d* may be formed in the form that a concave recess (not shown), which enables the shielded electric wire 64 with the press-fitted terminal to be easily inserted into the through hole 66*d* even in a state that the press-fitted terminal (the connection terminal) is already fitted to the end portion (in FIG. 6, the right end portion) of the core wire 62 of the shielded electric wire 64 by the press-fitting, should be contained.

Then, the shielded electric wire 64 with the press-fitted terminal is passed through the through hole 66*d* of the ground member 66, and thus the shielding terminal 65 can be connected to the contact portion of the ground member 66. A part of the ground member 66, which is bent like an L shape, constitutes the connection portion that is connected electrically and fixed to the mounted body. This mounted body corresponds to the member that is connected electrically to the common ground portion in the vehicle or the common ground portion itself, for example.

The shielding terminal 65 consists of the shielding contact 67 and a shielding sleeve 68. This shielding contact 67 is formed of a conductive member of a hollow annular (pipe) shape. The shielding contact 67 is formed by linking together a large diameter part 67*a* of a hollow annular shape and the small diameter part 66*b* of a hollow annular shape. An open end of the large diameter part 67*a* is expanded in diameter outwardly in the radial direction by the curling, and also an open end of the small diameter part 66*b* is reduced in diameter like a taper shape. Also, this shielding sleeve 68 is formed of a conductive member of a hollow annular (pipe) shape. Here, in the shielded electric wire 64 to which the ground connector 61 is fitted, the core wire 62 is covered with an inner cover 69 as the insulating member, the inner cover 69 is covered with the braided shield 63 as a netlike conductor (i.e., shielding member), and the braided shield 63 is covered with an outer cover 70 as the insulating member.

In this ground connector, such processes are applied to one end portion of the shielded electric wire 64 that one end portion of the outer cover 70 is peeled off in a predetermined length to expose one end portion of the braided shield 63, then the shielded electric wire 64 is passed through the shielding sleeve 68, then the shielding sleeve 68 is arranged around one end portion of the outer cover 70 located near one end portion of the exposed braided shield 63, and then one end portion of the exposed braided shield 63 is folded back like an almost U shape in section to cover the outer peripheral surface of the shielding sleeve 68. Then, the large diameter part 67*a* of the shielding contact 67 is fitted onto one end portion of the folded-back braided shield 63, and then the large diameter part 67*a* as well as the shielding sleeve 68 and the shielded electric wire 64 is reduced in diameter by the clamping. Thus, the shielding contact 67, the shielding sleeve 68, and the braided shield 63 can be brought into a mutual conduction state without fail.

PRIOR TECHNOLOGY LITERATURE

Patent Literature

Patent Literature 1: JP-B-3977094
Patent Literature 2: JP-A-2005-285748

SUMMARY OF THE INVENTION

Problems to be Solved by the Invention

The above shielded electric wire connector 30 in the prior art has the following problems to be solved.

That is, the clamping is applied to the shielding contact 67 in the condition that the shielding sleeve 68 is put between the outer cover 70 and a part of the braided shield 63, which is folded back like a C shape at its cut end, nevertheless the shielding sleeve 68 is still kept in a hollow annular shape, as described above. Therefore, in some cases the shielding sleeve 68 is moved on the outer cover 70 even in the clamped state at the time when this shielding sleeve 68 undergoes an external force or vibrations during the laying work of the shielded electric wire 64, or the like. As a result, such a disadvantage is caused that the folded-back part of the braided shield 63 interferes with the surface of the outer cover 70 by this movement, and the sharp end portion of the braided shield 63 damages the surface of the outer cover 70.

The present invention has been made in view of the above circumstances, and it is an object of the present invention to provide a shielded connector capable of avoiding the damage of an outer cover without fail, by restricting a displacement of a shielding sleeve itself on an outer cover or by preventing interference of a shielding member on the shielding sleeve with an outer cover as an insulating cover in the situation that a shielding terminal is clamped onto an inner cover of a shielded electric wire via the shielding member and the shielding sleeve.

Means for Solving the Problems

In order to attain the above object, the shielded connector according to the present invention has a following aspect (1) as a feature.

(1) A shielded connector for ground-connecting a shielding member of a shielded electric wire, which has a core wire and the shielding member extended along a longitudinal direction of the core wire to sheathe the core wire, to a conductive mounted body, comprising:

a hollow cylindrical shielding sleeve that is arranged between one part of the shielding member which is formed by folding back a predetermined length of the shielding member, which is exposed on an inner cover by removing an outer cover of the shielded electric wire, and an outer cover which corresponds to the one part;

a hollow cylindrical housing; and a shielding terminal that is fitted to the housing and is attached together with the housing to the mounted body, and has a press-fitted portion being provided to extend into a cylindrical hole of the housing and clamped so as to cover a part of the shielding member, which corresponds to the shielding sleeve, of the shielded electric wire which is inserted into the cylindrical hole, wherein the shielding sleeve has an upstanding piece which stands up in an outer diameter direction to prevent an end portion of the shielding member or an end portion of the shielding terminal from contacting with the outer cover.

According to the configuration in above (1), in the case where the outer cover of the shielded electric wire and the shielding member (braided shield) are cut by the cutter, or the like to expose the inner cover, and then a part of the shielding member exposed on the inner cover is put on the shielding sleeve that is fitted onto the periphery of the outer cover located near the cut portion, and then the press-fitted portion of the shielding terminal is superposed thereon, respective end portions of the shielding member and the shielding terminal, which cover this shielding sleeve, are held on the inner side of the upstanding piece that stands up gently with respect to the outer cover. As a result, when a press-fitting force is applied to the press-fitted portion of the shielding terminal, such a situation can be avoided that the whole shielding sleeve is caused to contact to the whole surface of the outer cover with pressure and thus the press-fitting force is applied intensively to a part of the surface of the outer cover. In addition, even when the shielded electric wire gets an external force or vibrations at a time of laying the wire, the upstanding piece restricts a movement (displacement) of the sharp end portion of the shielding member, which is caused by the cutting. As a result, such a situation can be avoided that the sharp end portion of the shielding member is stuck into the outer cover, or the like to damage the surface of this outer cover.

Advantages of the Invention

According to the present invention, such advantages can be achieved that, when the press-fitted portion of the shielding terminal is press-fitted onto the shielding member, not only the shielding terminal and the shielding member can be set not to directly interfere with the outer cover because the shielding member is positioned on the inner cover of the shielded electric wire via the shielding sleeve, but also it can be attained that the end portion of the shielding sleeve or the sharp end portion of the shielding member being protruded from the shielding sleeve does not damage the outer cover because respective displacements of the end portion and the sharp end portion are restricted.

With the above, the present invention is explained concisely. Further, when "Mode for Carrying Out the Invention" to be explained hereinafter is read through with reference to the accompanying drawings, details of the present invention will be made clear much more.

MODE FOR CARRYING OUT THE INVENTION

A shielded connector according to an embodiment of the present invention will be explained with reference to FIG. 1 to FIG. 4 hereinafter.

Figure 1:
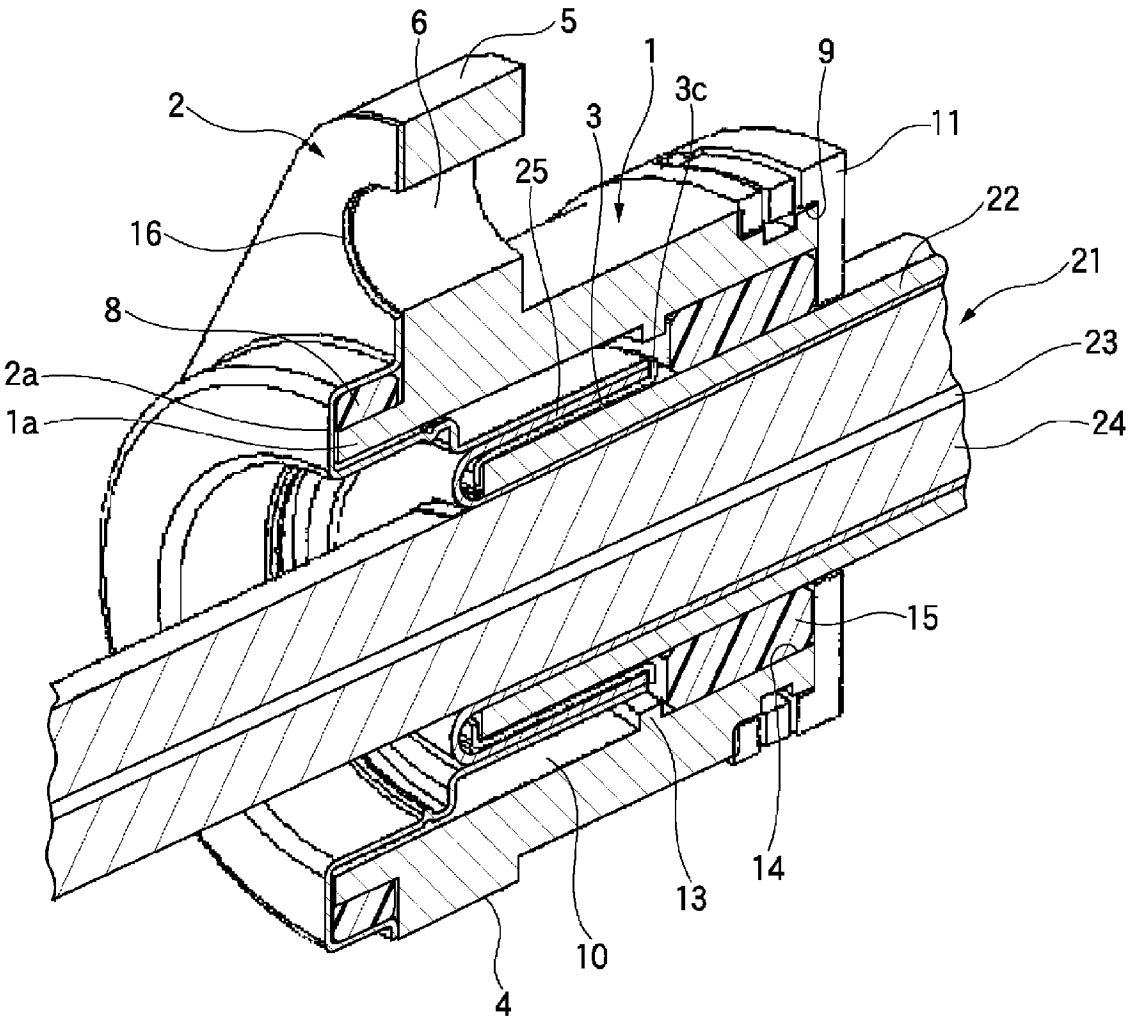
FIG. 1 is a longitudinally sectioned perspective view showing a shielded connector according to an embodiment of the present invention.
Figure 2:
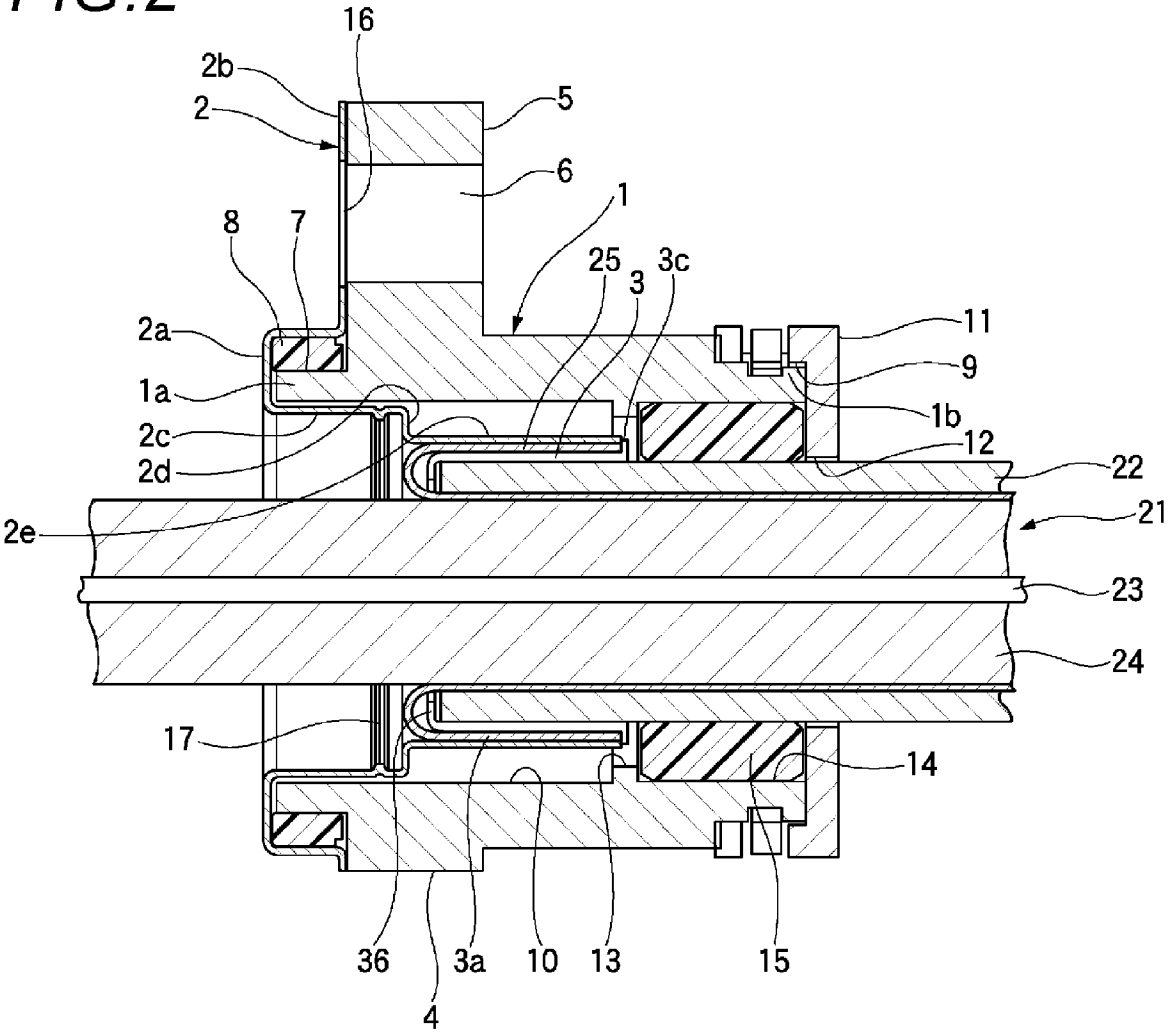
FIG. 2 is a longitudinal sectional view of the shielded connector shown in FIG. 1.

As shown in FIG. 1 and FIG. 2, a shielded connector according to the present embodiment includes a housing 1, a shielding terminal 2, and a shielding sleeve 3. Out of them, the housing 1 is formed of an insulating member such as a synthetic resin, or the like, and is molded like a hollow cylindrical shape. The housing 1 has a projected brim 4 on its outer periphery, and this projected brim 4 is provided to enhance strength of the housing 1. Also, this projected brim 4 has a fitting piece 5. A part of the fitting piece 5 is expanded like a mountain shape. A fitting hole 6 is provided in an almost center portion of the fitting piece 5, and a fastening tool such as a bolt, or the like, can be inserted and passed through this fitting hole 6. This fitting hole 6 as well as the shielding terminal 2 is provided to fit the housing 1 to a body of a car by using the bolt or the screw, as described later.

Also, the housing 1 has a waterproof packing installation portion 7 on an outer periphery of a reduced diameter portion 1*a* on one side (in FIG. 2, left side) of the fitting piece 5. A waterproof packing 8 is attached onto the installation portion 7, and this waterproof packing 8 has an almost rectangular section and is formed like an annular shape as a whole. The housing 1 has a screw thread 9 on an outer periphery of a reduced diameter portion 1*b* on the other side of the fitting piece 5. An annular blocking plate 11 for blocking one end of a cylindrical hole 10 of the housing 1 is screwed onto this screw thread 9. An insertion hole 12, through which a shielded electric wire 21 described later is passed, is formed in a center portion of this annular blocking plate 11.

Also, the housing 1 has an annular projection 13 on an inner periphery of the cylindrical hole 10. One side (in FIG. 2, right side) of this annular projection 13 constitutes a container portion 14 in which the annular waterproof packing is set up. A waterproof packing 15 is fitted into this container portion 14 in its compressed state. The waterproof packings 8, 15 are formed of buffer material such as rubber, synthetic resin, or the like in appropriate shape and size respectively, and keep the inside of the cylindrical hole 10 of the housing 1 in an almost watertight state.

The shielding terminal 2 is formed by shaping a conductive metal plate by using the press working. This shielding terminal 2 has a ring-like convex portion 2*a*, a mountain-shaped fitting piece 2*b*, a cylindrical portion 2*c*, and a cylindrical press-fitted portion 2*e*. This ring-like convex portion 2*a* is bent to cover simultaneously the reduced diameter portion 1*a*, which is extended toward one side (in FIG. 2, left side) of the fitting piece 5, of the housing 1 and the waterproof packing 8. This mountain-shaped fitting piece 2*b* is continued from an outer peripheral side of the ring-like convex portion 2*a* and is brought into contact to one side of the fitting piece 5, as described later. This cylindrical portion 2*c* is continued from an inner peripheral edge of the ring-like convex portion 2*a* in parallel with a centerline of the housing 1. This cylindrical press-fitted portion 2*e* is continued from the cylindrical portion 2*c* via a stepped portion 2*d* in parallel with a centerline of the housing 1, and has a smaller diameter than the cylindrical portion 2*c*. One end portion of the cylindrical press-fitted portion 2*e* is opened. When the shielding terminal 2 is attached to the housing 1, an end portion of the press-fitted portion 2*e* is positioned near the annular projection 13, as shown in FIG. 1 and FIG. 2.

Also, a shape of the fitting piece 2*b* of the shielding terminal 2, when viewed from the side, is substantially identical to the fitting piece 5 of the housing 1. A fitting hole 16, which has the same shape and the same size as those of the fitting hole 6 formed in the fitting piece 5, is provided in this fitting piece 2*b*. The fitting holes 6, 16 are formed to communicate with each other, as shown in FIG. 1 and FIG. 2. The shielding terminal 2 can be fitted electrically and mechanically to the body of the car by passing the metal (conductive) bolt or screw through these fitting holes 6, 16. Also, a reinforcing rib 17 having a predetermined height in the inner diameter direction is formed in the cylindrical portion 2*c* of the shielding terminal 2 by the drawing process. Thus, mechanical strength for the crush, or the like of this cylindrical portion 2*c* is enhanced.

Figure 3:
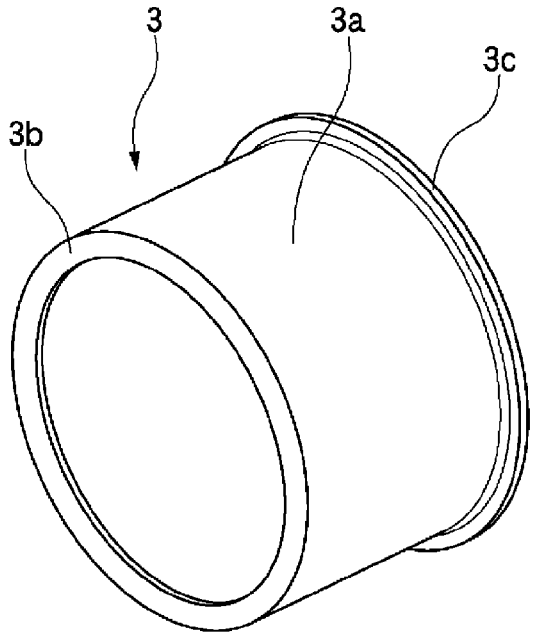
FIG. 3 is a perspective view of a shielding sleeve shown in FIG. 1.
Figure 4:
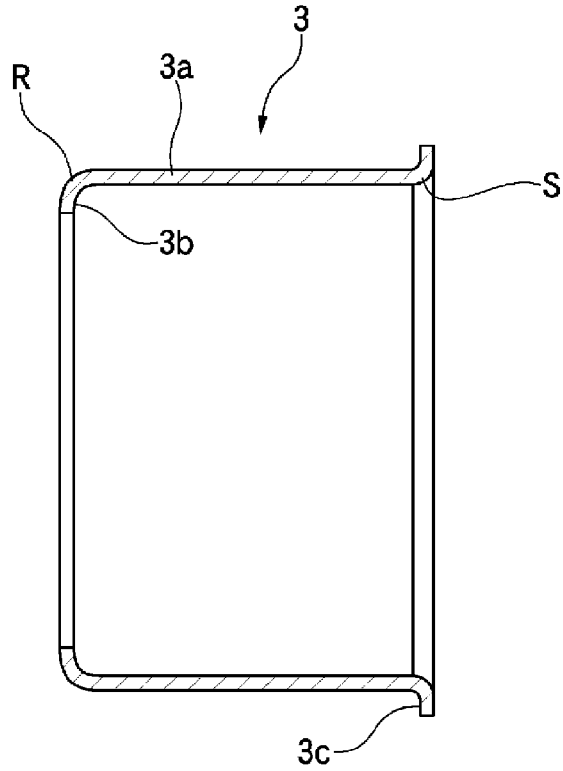
FIG. 4 is a longitudinal sectional view of the shielding sleeve shown in FIG. 1.
Figure 5:
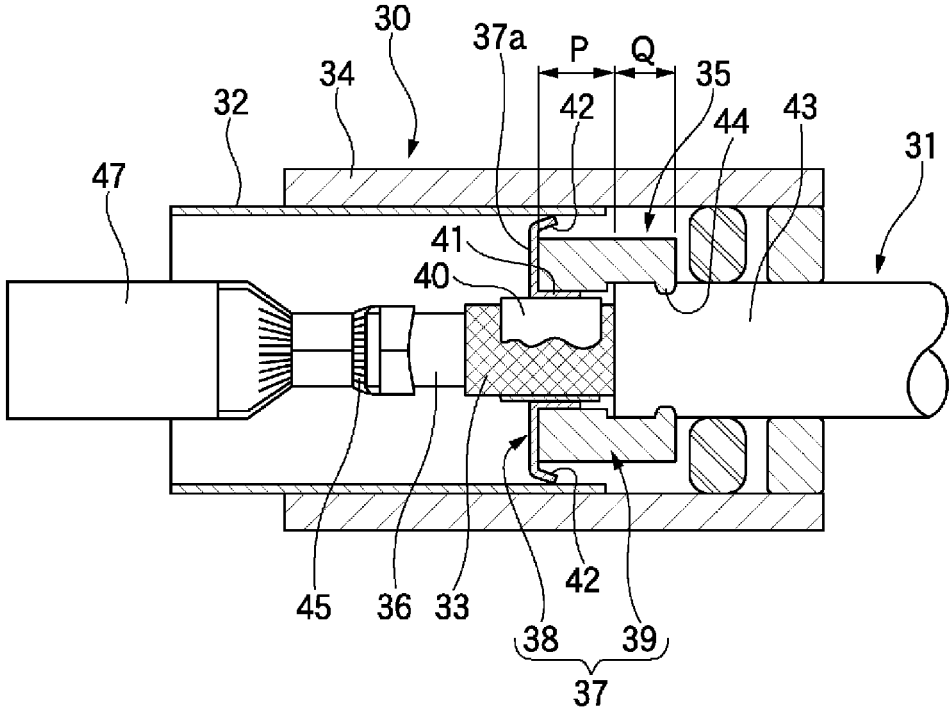
FIG. 5 is a longitudinal sectional view showing a shielded electric wire connector in the prior art.
Figure 6:
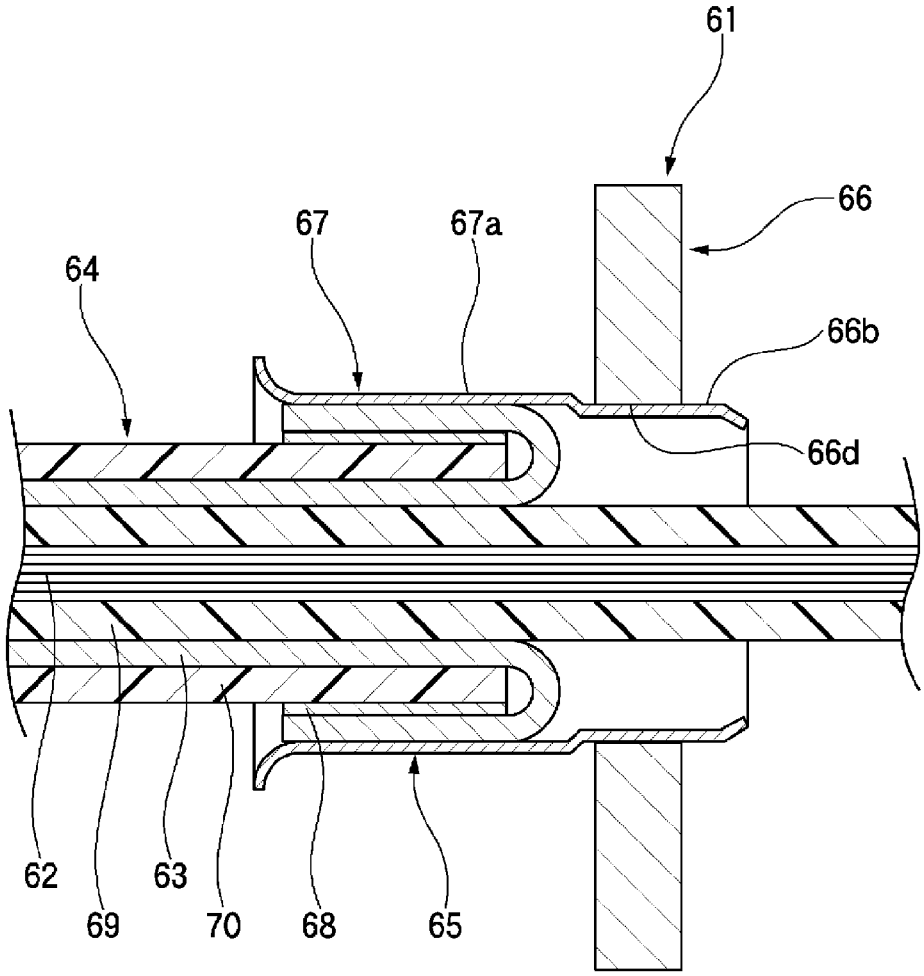
FIG. 6 is a longitudinal sectional view showing a ground connector in the prior art.

The shielding sleeve 3 is formed of a conductive metal cylinder, and is shaped by the press working, as shown in FIG. 3 and FIG. 4. Also, as shown in FIG. 1 and FIG. 2, an inner diameter of the shielding sleeve 3 is set substantially equal to an outer diameter of an outer cover (sheath) 22 of the shielded electric wire. Accordingly, the inner diameter of the shielding sleeve 3 is set in size to come in tight contact with an outer diameter dimension of the shielded electric wire 21 that is inserted into the cylindrical hole 10 of the housing 1, i.e., the outer periphery of the outer cover 22. The shielding sleeve 3 has a cylinder portion 3*a* having the identical diameter in a whole length, a reduced diameter piece 3*b* bent by an almost right angle toward a centerline of this shielding sleeve 3 at one end of this cylinder portion 3*a*, and an upstanding piece 3*c* that stands up by an almost right angle toward the outer (outer diameter) direction of the shielding sleeve 3 at the other end of this cylinder portion 3*a*.

Here, the reduced diameter piece 3*b* and the upstanding piece 3*c* are rounded like circular arc surfaces R, S, an outer surface of which is made smooth, at corner portions that are continued to the cylinder portion 3*a*, respectively. In this case, an upstanding height of the upstanding piece 3*c* is set equal to a height that is decided by adding a thickness of a shielding member (braided shield) 25, which is superposed on the outer periphery of the cylinder portion 3*a*, and a thickness of the press-fitted portion 2*e* of the shielding terminal 2, as described later. The upstanding piece 3*c* is set in length and size to prevent that the shielding member 25 and the press-fitted portion 2*e* extend beyond the upstanding piece 3*c* onto the outer cover 22.

In FIG. 2, the shielded electric wire 21 is constructed such that a core wire 23 is covered with an inner cover 24 as an insulating material, then this inner cover 24 is covered with the shielding member 25 as a netlike conductive material (braided shield), and then this shielding member 25 is covered with the outer cover (sheath) 22. In the present embodiment, the shielding member 25 is exposed by cutting a part of the outer cover 22 to be located near the housing 1 of the shielded connector, which is fitted to the body of the car, by means of a cutter, or the like, and then the shielded electric wire 21 is cut by the cutter, or the like such that this shielding member 25 has a predetermined length. Thus, the inner cover 24 is exposed.

Also, the cylinder portion 3*a* of the shielding sleeve 3 is fitted onto the outer periphery of the outer cover 22 such that the reduced diameter piece 3*b* of the shielding sleeve 3 engages with the cut end of the outer cover 22. Meanwhile, the shielding member 25 of a predetermined length, which is left after the shielding member 25 is cut in a predetermined length by the cutter, is folded back onto the cylinder portion 3*a* of the shielding sleeve 3, which is provided to cover the outer cover 22, to cover the reduced diameter piece 3*b* from the outside. The top end portion of the folded-back part of the shielding member 25 is positioned on the inner side (in FIG. 1, left side) of the upstanding piece 3*c*.

The shielding member 25 that is folded back onto the cylinder portion 3*a* is inserted into the press-fitted portion 2*e* of the shielding terminal 2. Then, a press-fitting force is applied to the press-fitted portion 2*e* from the outer periphery. Thus, the press-fitted portion 2*e* holds integrally the shielded electric wire 21 containing the outer cover 22, the shielding member 25, the inner cover 24, and the core wire 23 in the cylindrical hole 10 of the housing 1 via the shielding member 25 and the shielding sleeve 3.

In this case, the shielding sleeve 3 gets a large press-fitting force from the press-fitted portion 2*e* of the shielding terminal 2, and then the end portion and its neighborhood of the shielding sleeve 3 is curled around a contact point between a top end of the reduced diameter piece 3*b* and the shielding member 25 in such a manner that this end portion is turned or tilted toward an inner area of the outer cover 22 from its surface. However, the circular arc surface R of the shielding sleeve 3 comes gently in contact with the outer cover 22 at the time of this turning or tilting. Therefore, the damage of the outer cover 22 caused by the circular arc surface R can be avoided.

Also, respective end portions of the shielding member 25 and the press-fitted portion 2*e* of the shielding terminal 2 on the shielding sleeve 3 are designed in length in advance not to protrude outwardly from the upstanding piece 3*c*. For this reason, such an event can be avoided that the top end portion of the press-fitted portion 2*e* and the sharp end portion of the shielding member 25 are bumped against the outer cover 22 or are stuck into the outer cover 22.

Next, procedures of attaching the shielded connector having such configuration will be explained hereunder.

First, the shielded electric wire 21 to be set up near the body of the car is passed sequentially through respective components of the insertion hole 12 of the blocking plate 11, the waterproof packing 15, the shielding sleeve 3, the cylindrical hole 10 of the housing 1, the waterproof packing 8, and the press-fitted portion 2*e* and the cylindrical portion 2*c* of the shielding terminal 2. Then, the outer cover 22 of the shielded electric wire 21 being passed through respective components is cut by using the cutter, or the like to remove respective parts located on the left side of the cut portion in FIG. 2. Then, the shielding member (braided shield) 25 exposed by this cutting is cut at a predetermined position, and then the parts located on the left side of the cut portion in FIG. 2 are removed to expose the inner cover 24. Therefore, such a state is set up that the shielding member 25 is exposed on the inner cover 24 in a predetermined length.

Then, the shielding sleeve 3, which is exposed on the inner cover 24 from the cut end of the outer cover 22 and whose length is slightly longer than the shielding member 25, is inserted and fitted onto the outer peripheral surface of the outer cover 22 within a predetermined length in which the cut end is contained. This insertion and fitting is done such that the reduced diameter piece 3*b* comes in contact with or engages with the cut end of the outer cover 22. Then, the shielding member 25 is folded back onto the shielding sleeve 3 around the cut end and its neighborhood of the outer cover 22.

On the contrary, the shielding terminal 2 and the housing 1 are assembled integrally. In this case, both the cylindrical portion 2*c* and the press-fitted portion 2*e* of the shielding terminal 2 are placed to face to the inside of the cylindrical hole 10 of the housing 1. Before or after the aligning operation of the fitting holes 6, 16, the ring-like waterproof packing 8 is fitted onto the installation portion 7 on the outer periphery of the reduced diameter portion 1*a*. Then, the assembled structure of the shielding terminal 2 and the housing 1 is moved toward the shielding member 25 that is kept in its exposed state. According to this movement, the press-fitted portion 2*e* of the shielding terminal 2 is fitted onto the periphery of the shielding member 25 such that this press-fitted portion 2*e* sheathes an outer periphery of the part, which is folded back on the shielding sleeve 3, of the shielding member 25, as described later. This press-fitted portion 2*e* press-fits and holds predetermined points of the shielding sleeve 3 and the outer cover 22 located near the cut portion via the shielding member 25. At this time, the top end portions of the shielding member 25 and the press-fitted portion 2*e* are restricted in motion by the upstanding piece 3*c* of the shielding sleeve 3 not to move outwardly beyond this upstanding piece 3*c*.

Then, the waterproof packing 15 is inserted and fitted into the container portion 14 located on the body side of the housing 1 in its compresses state. Then, the blocking plate 11 is screwed into the screw thread being cut around the reduced diameter portion 1*b* and is fixed thereto. Accordingly, the waterproof packings 8, 15 hold the shielding member 25 on the shielding sleeve 3 and the press-fitted portion 2*e* in the inside of the cylindrical hole 10 substantially in a watertight state.

Then, the fastening member such as the bolt, the screw, or the like is passed through the fitting holes 6, 16, and then is screwed into the common ground portion of the body of the car, the electric equipment, or the like to fix the shielding terminal 2 together with the housing 1. Accordingly, the shielding member 25, which shields electromagnetically the core wire 23 via the inner cover 24, is grounded to the body via the shielding terminal 2. As a result, the electromagnetic shielding effect of the shielding line can be enhanced.

As described above, according to the shielded connector of the present embodiment, in the case where the outer cover 22 of the shielded electric wire 21 and the shielding member (braided shield) 25 are cut by the cutter, or the like to expose the inner cover 24, and then the shielding member 25 as well as the press-fitted portion 2*e* of the shielding terminal 2 is superposed on the shielding sleeve 3 that is already fitted onto the cut portion and its neighborhood of the outer cover 22, both the shielding member 25 and the press-fitted portion 2*e* of the shielding terminal 2, which are covering the shielding sleeve 3, are held on the inner side of the upstanding piece 3*c* that is formed to stand gently up with respect to the outer cover 22. As a result, when a press-fitting force is applied to the press-fitted portion 2*e* of the shielding terminal 2, not only it can be avoided that the corner portion of the shielding sleeve 3 is bumped against the surface of the outer cover 22, but also it can be avoided that the sharp end portion of the shielding member 25 being formed by the cutting is stuck directly into the outer cover 22, or the like to damage this cover.

The present invention is explained in detail with reference to the particular embodiment. But it is obvious for these skilled in the art that various variations and modifications can be applied without departing a spirit and a scope of the present invention.

This application is based upon Japanese Patent Application (Patent Application No. 2010-153086) filed on Jul. 5, 2010; the entire contents of which are incorporated herein by reference.

INDUSTRIAL APPLICABILITY

According to the shielded connector of the present invention, such advantages can be achieved that, when the press-fitted portion of the shielding terminal is press-fitted onto the shielding member, not only it can be attained that the shielding terminal and the shielding member are placed not to directly interfere with the outer cover because the shielding member is positioned on the inner cover of the shielded electric wire via the shielding sleeve, but also it can be attained that the end portion of the shielding sleeve or the sharp end portion of the shielding member being protruded from the shielding sleeve does not damage the outer cover because respective displacements of the end portion and the sharp end portion are restricted.

DESCRIPTION OF REFERENCE NUMERALS AND SIGNS

1 housing
2 shielding terminal
2*a* ring-like convex portion
2*b* fitting piece
2*c* cylindrical portion
2*d* stepped portion
2*e* press-fitted portion
3 shielding sleeve
3*a* cylinder portion
3*b* reduced-diameter piece
3*c* upstanding piece
4 projected edge
5 fitting piece
6 fitting hole
7 installing portion
8 waterproof packing
9 screw thread
10 cylindrical hole
11 blocking plate
12 insertion hole
13 annular projection
14 container portion
15 waterproof packing
16 fitting hole
17 reinforcing rib
21 shielded electric wire
22 external cover (sheath)
23 core wire
24 internal cover
25 shielding member
R, S circular arc surface

The invention claimed is:

1. A shielded connector for ground-connecting a shielding member of a shielded electric wire, which has a core wire and the shielding member extended along a longitudinal direction of the core wire to sheathe the core wire, to a conductive mounted body, comprising:

a hollow cylindrical shielding sleeve that is arranged between one part of the shielding member which is formed by folding back a predetermined length of the shielding member, which is exposed on an inner cover by removing an outer cover of the shielded electric wire, and an outer cover which corresponds to the one part;

a hollow cylindrical housing; and a shielding terminal that is fitted to the housing and is attached together with the housing to the mounted body, and has a press-fitted portion being provided to extend into a cylindrical hole of the housing and clamped so as to cover a part of the shielding member, which corresponds to the shielding sleeve, of the shielded electric wire which is inserted into the cylindrical hole, wherein the shielding sleeve has an upstanding piece which stands up in an outer diameter direction to prevent an end portion of the shielding member or an end portion of the shielding terminal from contacting with the outer cover.

* * * * *